United States Patent [19]

Goncalves

[11] 4,073,406

[45] Feb. 14, 1978

[54] CONTAINER FOR STORING TWO PRODUCTS SEPARATELY AND DISPENSING A MIXTURE THEREOF

[75] Inventor: Antonin L. Goncalves, Groslay, France

[73] Assignee: L'Oreal, Paris, France

[21] Appl. No.: 740,066

[22] Filed: Nov. 8, 1976

[30] Foreign Application Priority Data

Nov. 17, 1975 France ..... 75 35033

[51] Int. Cl.[2] ..... B65D 35/22

[52] U.S. Cl. ..... 222/94

[58] Field of Search ..... 222/94, 129

[56] References Cited

U.S. PATENT DOCUMENTS 3,347,410 10/1967 Schwartzman ..... 222/129 X 3,441,179 4/1969 Ragan ..... 222/129

3,891,125 6/1975 Morane et al. ..... 222/129

*Primary Examiner*—Stanley H. Tollberg

*Assistant Examiner*—Norman L. Stack, Jr.

*Attorney, Agent, or Firm*—Brisebois & Kruger

[57] ABSTRACT

Container for storing two products separately and dispensing a mixture thereof comprises a bottle, a hollow cap for the bottle, and a plug which fits into the hollow cap to separate a chamber therein from the interior of the bottle. The cap comprises two depending skirts between which the neck of the bottle is gripped, and a flexible dome connecting the skirts to a spout. The plug is bowl shaped and has a portion projecting into the dome to a point near the base of the spout. When the spout is swung laterally, deforming the dome, part of its lower end strikes the plug, ejecting it from the cap.

12 Claims, 2 Drawing Figures

CONTAINER FOR STORING TWO PRODUCTS SEPARATELY AND DISPENSING A MIXTURE THEREOF

SUMMARY OF THE INVENTION

Figure 1:
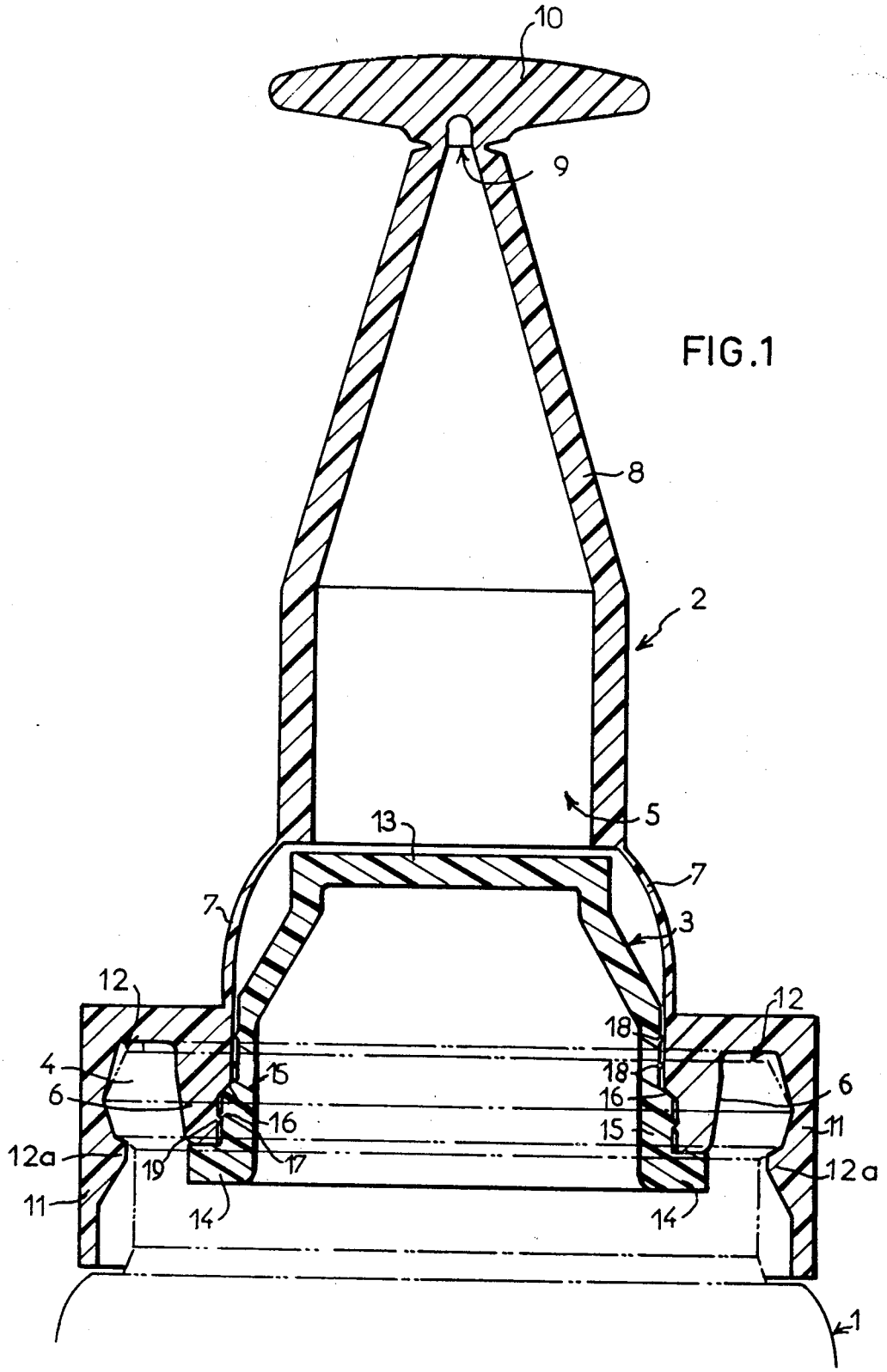

This invention relates to a container for storing and dispensing a mixture obtained from a liquid product and at least one additional product, said products being isolated one from the other before the distribution step.

Various devices have already been proposed for storing products separately in a single package when one of the products is liquid and it is desired to mix the two just before use. Certificate of addition No. 63463 to French Pat. No. 1054170 describes a storage container comprising two compartments, one of which consists of the body of the container itself, and the other of which consists of a hollow cap blocking the neck of the container. The cap consists of a tubular hollow body seated in the neck of the container with which the plug is associated. This body is closed at its upper end by a flexible deformable membrane which rests on the edge of the neck, and is open at its lower end. This opening is closed, during storage, by an ejectable separating plug. The upper membrane may be connected to an ejection push rod positioned inside the tubular body and terminating near the separating plug. In order to mix the two products contained separately in the container and in the hollow cap, the user deforms the flexible membrane by exerting pressure on it to expel the separating plug and consequently bring the two products into contact.

A first disadvantage of a device of this type is that it does not have any means for dispensing the mixture such as a dispensing spout, for example. This obliges the user either to pierce the flexible membrane with a hypodermic syringe so as to withdraw the mixture obtained from the container, or to pull out the plug to empty the mixture from the container. Moreover, the step of deforming the flexible membrane may be difficult to carry out when the separating plug is firmly gripped in the hollow cap to insure rigorous isolation of the two compartments.

It is the object of the present invention to mitigate the above disadvantages and, for this purpose, it is proposed to provide a storage and distribution container the hollow cap of which contains the additional product and constitutes a distribution cap having a dispensing spout provided, for example, with a detachable end which the user may, once the mixture has been produced, easily tear off so as to open an outlet. Moreover, the device according to the present invention is adapted to insure, under all circumstances, the separation of the separating plug and the hollow cap regardless of the force with which the outer cap grips the separating plug. By acting simply on the dispensing spout which serves as an actuating lever, the user may transversely swing it with respect to the axis of the container to push and detach the separating plug in order to release the contents of the hollow cap. A supplementary advantage of the device according to the invention results from the fact that it is inexpensive, because it is produced by simply assembling three pieces molded from plastic material, to wit a hollow cap serving as a dispensing cap, an ejectable separating plug, and a bottle having a neck which the hollow cap is adapted to fit. Finally, the introduction of the additional product into the hollow cap and its isolation by the separating plug takes place during a first storage step while the container is being filled at a separate station, the assembly of the hollow cap and separating plug onto the full container constituting the second packaging step. These steps may easily be carried out at high speed on the same automatic machine.

It is therefore an object of the present invention to provide a storage and distribution container for a mixture obtained from a liquid product and at least one additional product, said products being isolated from each other before dispensing, the liquid product being contained in the body of the container, the additional product being contained in a hollow cap, and the hollow space within the cap communicating with the interior of the container through an orifice in which a separating plug is inserted. This separating plug is adapted to be driven into the body of the container by deformation of a zone of the flexible wall of the outer plug. The invention is characterized by the fact that the orifice is bordered by a skirt positioned inside the body of the container, said inner skirt being connected by a deformable dome to a dispensing spout, the separating plug being positioned inside the inner skirt and gripped thereby, said separating plug projecting into the dome to the vicinity of the zone at which the dome is attached to the dispensing spout, so that by pivoting the dispensing spout with respect to the axis of the skirt, (which deforms the dome) the separating plug is pushed by the part of the spout which is connected to the dome so as to be ejected from the inner skirt.

In a preferred embodiment of the invention the separating plug is fitted into the inner skirt of the cap and has the shape of a bowl, the bottom of which is directed toward the dispensing spout. The end of the separating plug which is remote from the bottom of the bowl is provided with a peripheral collar which rests on the corresponding edge of the inner skirt. The part of the plug which is not gripped by the inner skirt comprises a lateral wall having a frusto-conical shape, the diameter of which decreases toward the bottom of the bowl. The part of the lateral wall which is gripped by the inner skirt is cylindrically shaped and complementary to the wall of said skirt. The part of the lateral wall of the plug which cooperates with the inner skirt comprises on its outer surface a shoulder which divides it into two zones, a first zone to the edge of which the peripheral collar is connected and which is provided with a snap-fitting ring, and a second zone of smaller diameter which is provided with two sealing rings which frictionally cooperate with a corresponding zone of the wall of the inner skirt. The snap-fitting ring provided on the first zone of the wall of the separating plug and which cooperates with the inner skirt snaps behind a retaining ring formed on the corresponding zone of the wall of the inner skirt to insure the mounting of the plug in the skirt. The cap comprises, in the zone thereof attached to the container, an outer skirt encircling the inner skirt and disposed concentrically with respect thereto, the inner and outer skirts delimiting a groove having a wall provided with a snap-fitting ring. The cap is attached to the container by snap-fitting the end of the neck of the container into said groove. The deformable dome narrows toward the dispensing spout and has a wall thickness which decreases progressively in the direction of the dispensing spout. The dispensing spout has an axis which coincides with that of the neck of the container and the shape of a cone, the diameter of which decreases toward the end of the spout which is remote from the end connected to the dome. The dispensing spout delimits at its upper end an outlet blocked by a sealing plate which extends substantially perpendicularly to the axis of the spout. This plate is connected to the spout by a frangible zone. The cap and the inner plug are made of a plastic material such as polyethelene.

In order to store separately two products which are not to be mixed before use by means of the device according to the invention, the container is filled with a liquid product and the cap positioned upside down is filled with an additional liquid or powdered product. After forcing the separating plug into the inner skirt of the cap, the cap is turned over and the neck of the container is closed by snapping the cap on said neck. It will be appreciated that a plug such as above described insures rigorous isolation between the compartment of the hollow cap which contains the additional product and the inner space within the container which holds the liquid product.

In order to produce and dispense the mixture, the user seizes the body of the container in his open hand and, by a simple and rapid gesture, swings the rigid dispensing spout laterally. In this way the lower edge of the spout is forced into the deformable dome and acts on the bottom of the plug to eject it from the inner skirt. Since the dispensing spout is adapted to swing about any zone of the wall of the deformable dome, the swinging movement may be carried out in any direction without requiring preliminary orientation of the fingers of the user with respect to the dispensing spout. Once this step has been carried out, the dispensing spout may, if so desired, be straightened to its initial position. Simple agitation may then be used to intimately mix the two products which have been brought into contact with each other, and the user may then detach the sealing plate which blocks the dispensing spout in order to open the outlet.

Figure 2:
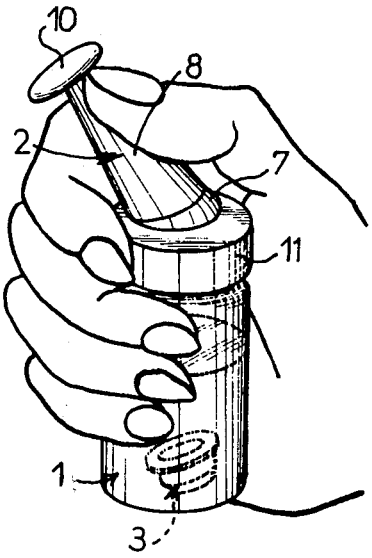

In order that the object of the invention may be better understood, one embodiment thereof will now be described, purely by way of illustration and example, with reference to the accompanying drawings on which:

FIG. 1 represents an axial longitudinal sectional view of the cap of a container for storing and distributing according to the invention, shown during storage, with the separating plug inserted in the cap, the container being partially shown in broken lines; and FIG. 2 shows in perspective a container provided with the cap of FIG. 1, when the dispensing spout has been swung and the plug driven into the body of the container.

Referring now to the drawings, it will be seen that the storage and dispensing container comprises a bottle 1, a hollow cap 2, and a separating plug 3.

The bottle 1 is adapted to hold a liquid product. It is advantageously made of a plastic material such as polyethelene. The bottle comprises, in a conventional manner, a neck bordered at its upper end by an external collar 4.

The cap 2 which fits on the neck of the bottle 1 is recessed at 5. This recess constitutes the compartment in which a powdered product or a tablet which one desires to dissolve in a liquid product contained in the bottle is placed. The compartment 5 has a tubular shape, is in alignment with the axis of the neck of the container, and is open at its lower end, which defines an orifice encircled by a skirt 6 positioned inside the neck. The separating plug 3 is forced into the cylinder defined by the skirt 6 to close the compartment 5. The inner skirt 6 is connected by the dome 7, having a deformable wall, to the dispensing spout 8.

The dome 7, which forms an extension of the wall of the skirt 6, narrows in the direction of the dispensing spout 8. The thickness of the wall of the deformable dome 7 decreases progressively toward the edge of the spout 8 to which it is connected.

The spout 8, which internally delimits the upper part of the compartment 5, has a wall thickness greater than that of the dome 7. It has a generally frusto-conical shape, its axis being substantially identical with that of the neck. At its lower end the dispensing spout consists of a section having a cylindrical wall. This section is surmounted by a conical section the tip of which defines an outlet 9. The outlet 9 is closed by a sealing plate 10 which is connected by a thin zone to the edge of the outlet 9. Plate 10 is circular and extends perpendicularly to the axis of the dispensing spout 8. The cap 2 comprises, where it is attached to the neck of the bottle 1, an external skirt 11 which encircles the internal skirt 6 and is positioned concentrically thereof. The two skirts 6 and 11 define a groove 12, one wall of which is provided with a snap fitting ring 12*a*. To put the cap 2 in place on the neck of the bottle 1, the collar 4 of the neck is snapped into the groove 12.

The liquid product contained in the container one is isolated during storage from the additional product placed in the compartment 5 of the cap tube by blocking the opening of the compartment defined by the inner skirt 6 with the plug 3. This plug 3 is in the shape of a bowl, the bottom of which is adapted to be positioned inside the part of the compartment 5 which is defined by the deformable dome 7, slightly below the lower edge of the dispensing spout 8. The part of the lateral wall of the plug 3 which is adapted to be contained in the deformable dome 7 converges in the direction of the bottom 13 of the plug, which bottom has a diameter less than the smallest inner diameter of the skirt 6 to facilitate the introduction of the bottom 13 into the deformable dome 7 and, conversely, the removal of the bottom 13 from the dome 7 during the expulsion of the plug 3. The end of the plug which is remote from the bottom 13 of the bowl is provided with a peripheral collar 14 bearing on the inner edge of the inner skirt 13 at the moment at which the plug is seated in the inner skirt. The part of the lateral wall 15 of the plug which cooperates with the inner skirt 6 has a shoulder 16 which divides it into two zones—a first zone bordered at its lower end by the peripheral collar 15, and a second zone having a smaller outer diameter. A snap fitting ring 17 is formed on the first zone and, when the plug 3 is being positioned in the cap, snaps behind a retaining ring formed on the corresponding zone of the inner wall of the skirt 6. Two sealing rings 18 are provided in the second zone, which frictionally cooperate with the corresponding zone of the inner wall of the skirt 6. The inner wall of the skirt 6 is complementary in shape to the zone of the lateral wall 15 of the plug 3.

The storage and dispensing container which has just been described is assembled as follows: The liquid product is placed inside the bottle 1 and the additional product is placed inside the compartment 5 of the cap 2 while it is upside down. The separating plug 3 is then forced in until the peripheral collar 14 abuts against the edge of the skirt 6 so as to snap fit the plug in the cap by snapping the retaining ring 17 behind the retaining ring 19. The force required to position the plug in the cap 2 is, in this embodiment, of the order of 130 Newton.

The location of the plug 3 in the cap 2 is shown in a detailed manner in FIG. 1. It will be observed that the bottom 13 of the plug 3, the outer diameter of which is slightly greater than the internal diameter of the lower edge of the dispensing spout 8, is positioned perpendicularly to the axis of the plug 2 just below the lower edge of the spout 8. After locating the plug 3 inside the cap 2, the cap is turned over and then mounted in the neck of the bottle 1 by snapping the collar 4 on the end of the neck into the groove 12.

When it is desired to mix the two products separately contained in the cap 2 and the bottle 1, the user, as illustrated in FIG. 2, takes the storage and dispensing container in his hand and, for example with his thumb, laterally swings the dispensing spout 8 by deforming the thin wall of the dome 7. A zone of the lower edge of the spout is, in the course of the swinging movement, depressed into the dome 7 to bear against the bottom 13 of the plug and, by reason of the force exerted thereon, drive the plug 3 out of the inner mounting skirt. The plug 3, once released from the skirt 6, falls into the container 1 and the additional product contained in the plug 2 also falls into the liquid with which it may mix while protected from the exterior atmosphere and any contact with the fingers of the user.

In order to dispense the mixture produced in this manner it suffices to tear the sealing plate 10, by tearing the weakened zone of the wall which connects the plate to the spout to open the outlet 9.

It will of course be appreciated that the embodiment which has just been described has been given purely by way of illustration and example, and may be modified as to detail without thereby departing from the basic principles of the invention.

What is claimed is:

1. In a container for storing a liquid product and at least one additional product separately, and for dispensing a mixture of said products, said container comprising:

a body for holding said liquid product, a hollow cap for said body, said cap defining therewithin a chamber adapted to hold said additional product, and an orifice positioned between said chamber and the interior of said body when said cap is in position on said body, and a separating plug adapted to seal said chamber off from said body, the improvement which comprises:

an inner skirt formed in said cap encircling said orifice, a deformable dome formed in said cap above said skirt, and a relatively rigid dispensing spout connected to the top of said dome said spout being pivotable, said plug having a lateral wall at least part of which is adapted to be gripped by said skirt and said plug projecting into said dome to an extent such that, when said spout is swung laterally, thus deforming said dome, a part of the spout is pressed against the plug to eject it from said skirt.

2. Container as claimed in claim 1 in which said plug has the shape of a bowl, the bottom of which is directed toward the dispensing spout when the plug is inserted in the inner skirt.

3. Container according to claim 2 in which the end of the plug which is remote from the bottom of the bowl is provided with a peripheral collar which bears on the corresponding edge of the inner skirt.

4. Container according to claim 2 in which the plug comprises a frusto-conical lateral wall portion which is not gripped by the skirt, the diameter of which wall portion decreases toward the bottom of the bowl, the part of the lateral wall which is gripped by the inner skirt being cylindrical in shape and complementary to said skirt.

5. Container according to claim 1 in which the part of the lateral wall of the plug which cooperates with the inner skirt comprises a shoulder on its external surface dividing said wall part into two zones, a first zone of larger diameter carrying a peripheral collar at its edge and which is provided with a snap-fitting ring, and a second zone of smaller diameter which is provided with two sealing rings which frictionally cooperate with a corresponding part of the wall of the inner skirt.

6. Container as claimed in claim 5 in which the snap-fitting ring formed on said first zone snaps behind a retaining ring formed on a corresponding zone of the wall of the inner skirt to fasten the plug in the skirt.

7. Container as claimed in claim 1 in which a part of the cap adapted to be attached to the container comprises an outer skirt encircling the inner skirt and positioned concentrically with respect thereto, the inner and outer skirts defining a groove having a wall provided with a snap fitting flange, the cap being attached to the container by snapping a flange at the end of the neck of the container into said groove.

8. Container as claimed in claim 1 in which the dome narrows toward the dispensing spout and has a wall thickness which decreases progressively in the direction of the dispensing spout.

9. Container as claimed in claim 1 in which the dispensing spout has an axis which substantially coincides with that of the neck of the container, a conical shape, and decreases in diameter toward the end of the spout which is remote from the one connected to the dome.

10. Container according to claim 1 in which the dispensing spout delimits at its upper end an outlet blocked by a sealing plate extending substantially perpendicular to the axis of the spout, said plate being connected by a frangible zone to the dispensing spout.

11. A container according to claim 1 wherein said dispensing spout includes a rigid sidewall, and said part of the spout which is pressed against the plug to eject it comprises an end of the sidewall of the spout.

12. In a container for storing a liquid product and at least one additional product separately, and for dispensing a mixture of said products, said container comprising:

a body for holding said liquid product, a hollow cap for said body, said cap defining therewith in a chamber adapted to hold said additional product, and an orifice positioned between said chamber and the interior of said body when said cap is in position on said body, and a separating plug adapted to seal said chamber off from said body, the improvement which comprises:

an inner skirt formed in said cap encircling said orifice, a deformable dome formed in said cap above said skirt, and a dispensing spout having a relatively rigid side wall with an upper end and a lower end, and connected to the top of the dome, said sidewall having a length substantially greater than the relaxed height of the dome, plug ejecting means on said lower end of the sidewall said spout being pivotable so that said ejecting means can engage said plug, said plug having a lateral wall at least part of which is adapted to be gripped by said skirt and said plug projecting into said skirt in opposed adjacent relation to said plug ejecting means such that, when said spout is pivoted, thus deforming said dome, said plug ejecting means of the spout is pressed against the plug to eject it from said skirt.

* * * * *